United States Patent [19]

Bidgood

[11] Patent Number: 4,860,834

[45] Date of Patent: Aug. 29, 1989

[54] CONVERTING ASSEMBLY

[76] Inventor: William E. Bidgood, 428 Seacroft Ct., Mequon, Wis. 53092

[21] Appl. No.: 142,531

[22] Filed: Jan. 7, 1988

[51] Int. Cl.[4] ..... E02F 3/96

[52] U.S. Cl. ..... 172/820; 414/912; 414/705; 414/723; 37/117.5; 172/817

[58] Field of Search ..... 414/682, 686, 687, 912, 414/607, 705, 723; 37/DIG. 3, DIG. 12, 117.5, 231, 241; 172/817, 818, 819, 820

[56] References Cited

U.S. PATENT DOCUMENTS

| | | | |
|---|---|---|---|
| 2,312,390 | 3/1943 | Cordes | 37/DIG. 3 |
| 2,997,796 | 8/1961 | Pogue et al. | 37/DIG. 3 |
| 3,002,638 | 10/1961 | Needy | 414/687 |
| 3,236,401 | 2/1966 | Wagner | 414/687 |
| 3,539,022 | 11/1970 | Berg | 414/705 X |
| 3,591,935 | 7/1971 | Brenner et al. | 172/819 X |
| 3,759,110 | 9/1973 | Davis | 172/819 X |
| 3,853,181 | 12/1974 | Yoshizaki | 172/820 |
| 3,907,143 | 9/1975 | Brown et al. | 172/819 X |
| 4,042,131 | 8/1977 | Buttke | 414/705 X |
| 4,120,366 | 10/1978 | Nisser et al. | 172/821 |
| 4,189,854 | 2/1980 | Haynes | 414/912 X |
| 4,217,075 | 8/1980 | Frank | 414/686 |
| 4,242,034 | 12/1980 | Schmitz | 414/686 |
| 4,274,213 | 6/1981 | Yadlowsky | 37/241 X |
| 4,314,789 | 2/1982 | Luigi | 414/705 X |
| 4,411,583 | 10/1983 | Petitto, Sr. et al. | 414/912 X |
| 4,419,040 | 12/1983 | Pedersen et al. | 414/687 |
| 4,488,850 | 12/1984 | Wernimont | 414/686 X |
| 4,552,503 | 11/1985 | Mouri et al. | 414/687 |
| 4,554,978 | 11/1985 | Schneider | 414/686 X |

FOREIGN PATENT DOCUMENTS

| | | | |
|---|---|---|---|
| 2109856 | 10/1971 | Fed. Rep. of Germany | 414/686 |
| 211298 | 1/1966 | Sweden | 414/686 |

*Primary Examiner*—Robert J. Spar
*Assistant Examiner*—William M. Hienz
*Attorney, Agent, or Firm*—Foley & Lardner

[57] ABSTRACT

The invention provides a converting assembly, cooperating with a general purpose tractor, for periodically interchanging an implement configured for side-to-side motion with one configured for a tilting motion about a horizontal axis. An illustrated embodiment includes a frame, rigidly but readily removably attached to the tractor lift frame members. A motion connector, pivotally mounted to the frame, cooperates with the tractor tilt cylinder and the implement to convert extension and retraction of the tilt cylinder into side-to-side motion of the implement.

23 Claims, 6 Drawing Sheets

FIG. 4
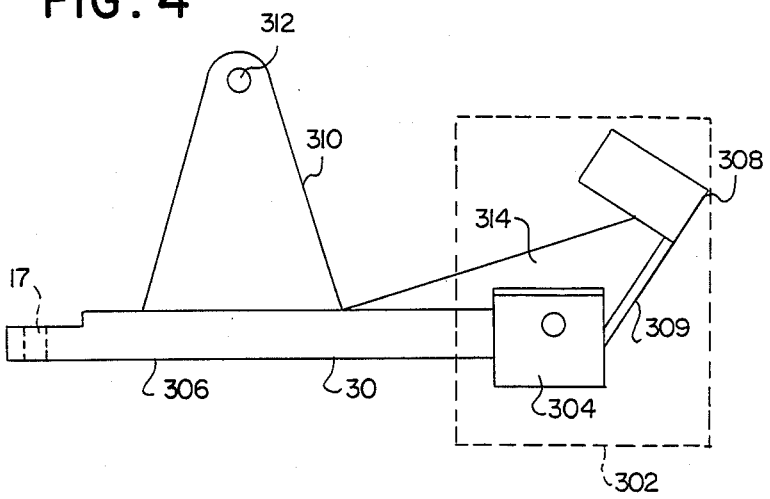
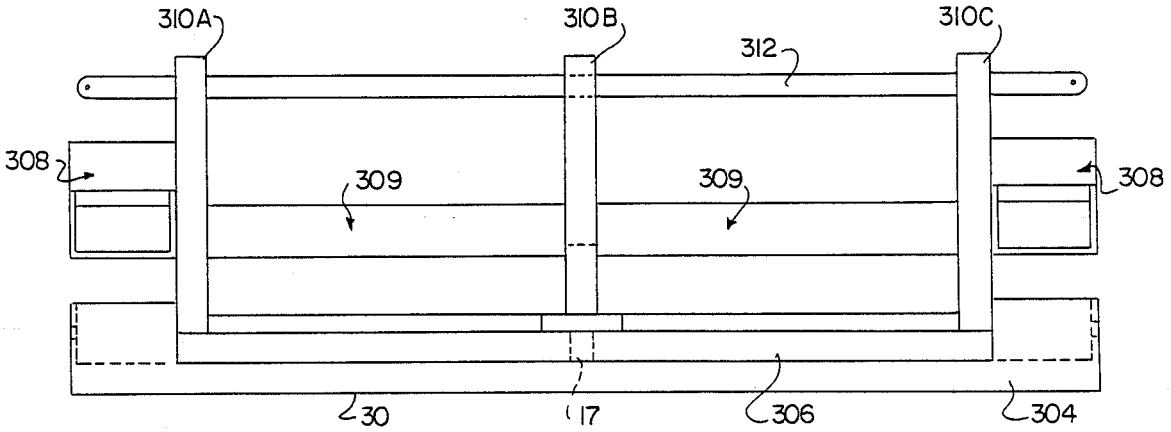
FIG. 3

CONVERTING ASSEMBLY

TECHNICAL FIELD

This invention relates, generally, to an assembly for periodically interchanging an implement requiring side-to-side motion in the horizontal plane with various implements requiring a tilt motion in the vertical plane on conventional multi-purpose tractors, and more particularly, to an interface bracket for interchanging implements having different motion requirements which allows the tractor lift frame and associated hydraulics to be left intact.

BACKGROUND OF THE INVENTION

Conventional multi-purpose tractors can be fitted with a variety of implements, e.g., dozer blades, snow plow blades, or bucket loaders. Because different implements often have different motion requirements, the hydraulics, underbody mounting brackets, and lift frame members associated therewith typically vary from implement to implement.

Movement of an implement is generally effected by hydraulic cylinders controlled by the operator from the cab or driver position of the tractor. Up and down motion is provided by a first pair of cylinders (generally referred to as lift cylinders); more precise motions, specific to the motion requirements of a particular implement, are provided by a second pair of cylinders. For example, a claw, digger or bucket loader may require up and down motion, provided by lift cylinders, and a pivot or "scooping" motion, provided by tilt cylinders. A snowplow, on the other hand, requires up and down motion, provided by lift cylinders and, ideally, a left to right sweeping motion pivoting about an axis perpendicular to the horizontal plane, provided by pivot cylinders.

If two implements sought to be interchanged have significantly different motion requirements, changing from one implement to the other can be quite cumbersome. Often the entire lift frame assembly, the underbody mounting brackets, and the associated hydraulic cylinders must be removed and replaced to accommodate the replacement implement's motion requirements.

SUMMARY OF THE INVENTION

The present invention facilitates effective and expedient changing of tractor implements having different motion requirements without changing lift frames, underbody mounting brackets, or cylinder configurations. This is accomplished by first removing the implement sought to be replaced, leaving the lift frame members and associated hydraulics intact. A frame is rigidly secured to the lift frame members and the desired implement is pivotally attached to the frame. A conversion mechanism interfaces the implement with the hydraulics to convert extension and retraction of at least one hydraulic cylinder in a first plane, into a desired predetermined motion of the replacement implement in a plane transverse to the first plane.

BRIEF DESCRIPTION OF THE DRAWING

A preferred exemplary embodiment of the present invention will hereinafter be described in conjunction with the appended drawing, wherein like numerals denote like elements, and:

FIG. 3 is a front view of the frame portion of the converting assembly;

FIG. 4 is a side view of the frame portion of FIG. 3;

DETAILED DESCRIPTION OF A PREFERRED EXEMPLARY EMBODIMENT

Figure 1:
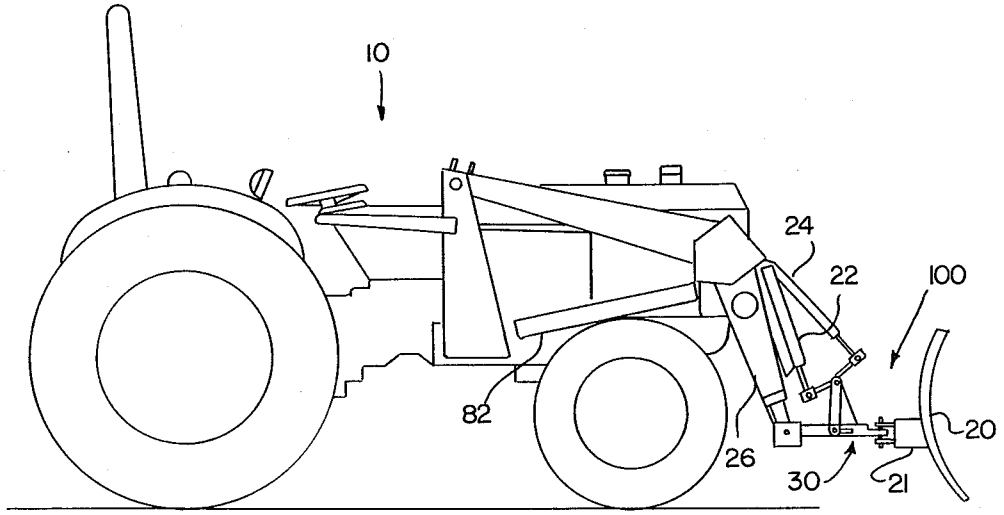
FIG. 1 is a side view of an exemplary embodiment of a converting assembly in accordance with the present invention, coupling an implement to the tilt cylinders and lift frame members of a conventional tractor.
Figure 8:
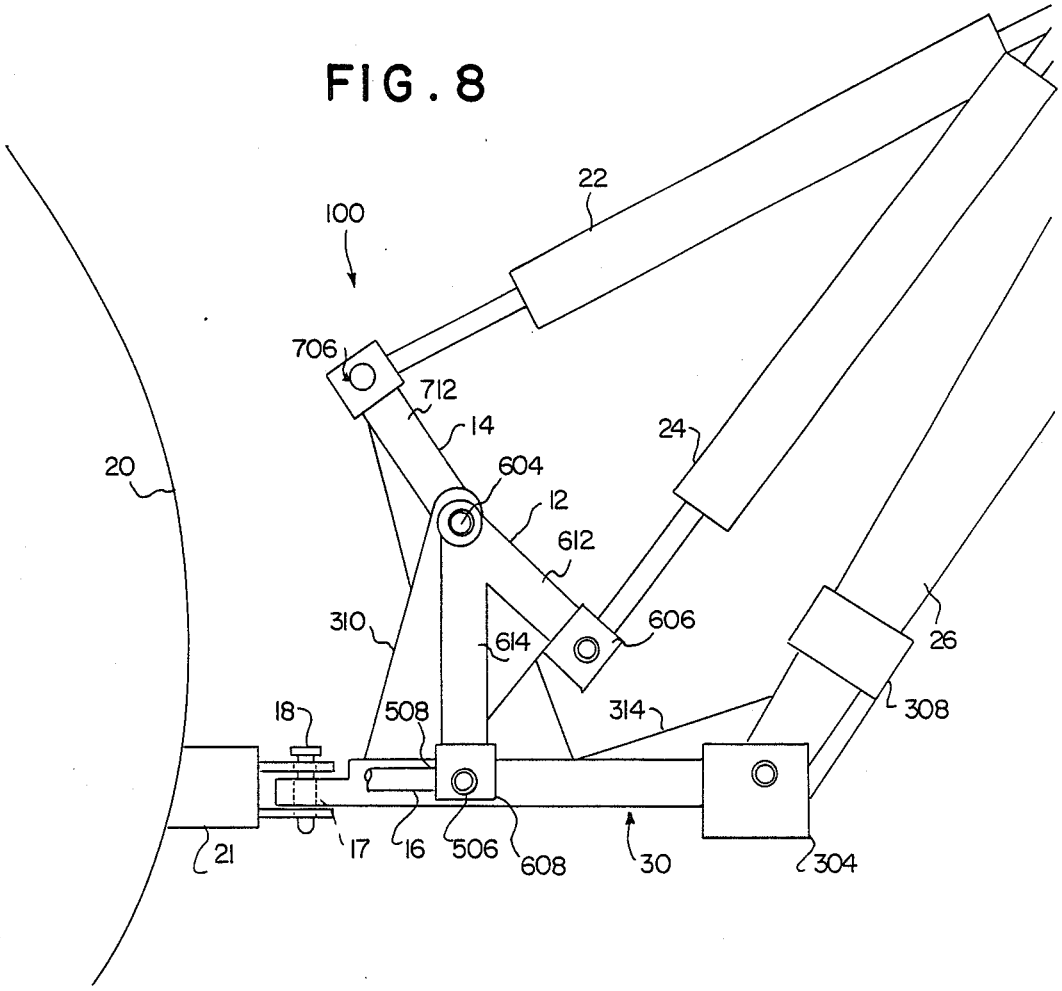
FIG. 8 is a side view of the converting assembly, with an implement pivotally attached thereto, secured to the lift frame members and tilt cylinders of a conventional tractor.

Referring now to FIGS. 1 and 8, a converting assembly 100 in accordance with the present invention secures an implement 20, e.g., a snowplow, having an integral bracket 21, to a conventional multipurpose tractor 10 which was previously adapted to cooperate with an implement requiring different controlled movement, e.g., a bucket loader. Tractor 10, when adapted to operate a bucket loader, conventionally includes respective mechanisms to lift the bucket vertically and to impart rotational, "scooping" motion to the bucket. Respective lift frame members 26 are disposed on opposing sides of, and extending forwardly of the front of tractor 10, operatively coupled to respective hydraulic cylinders (lift cylinders 82). A bucket is attached to the lift frame members, which cooperate with the lift cylinders to effect up and down motion of the bucket. The tilt cylinders cooperate with the bucket to provide the required scooping motion. Converting assembly 100 provides an interface between the new implement (e.g., snowplow) and tractor 10, and converts extension and retraction of tilt cylinders 22 and 24, which are configured to impart scooping motion to a bucket loader, into side-to-side motion of the snowplow.

With specific reference to FIG. 8, converting assembly 100 suitably comprises a frame 30, motion connectors 12 and 14, and respective turn connectors 16 (shown broken-away in FIG. 8). Frame 30 is rigidly connected to lift frame members 26 and pivotally connected to implement 20. Motion connectors 12 and 14 are pivotally connected to frame 30 and are connected at turn connector joints 506 to turn connectors 16 and tilt cylinders 22 and 24. As will hereinafter be more fully explained, lift cylinders 82 continue to impart up and down motion to the assembly, but extension and retraction of tilt cylinders 22 and 24 cause motion connectors 12 and 14 to pivot about frame 30, urging turn connectors 16 in opposite directions in a substantially horizontal plane, resulting in a sideways sweeping motion of implement 20.

Figure 2:
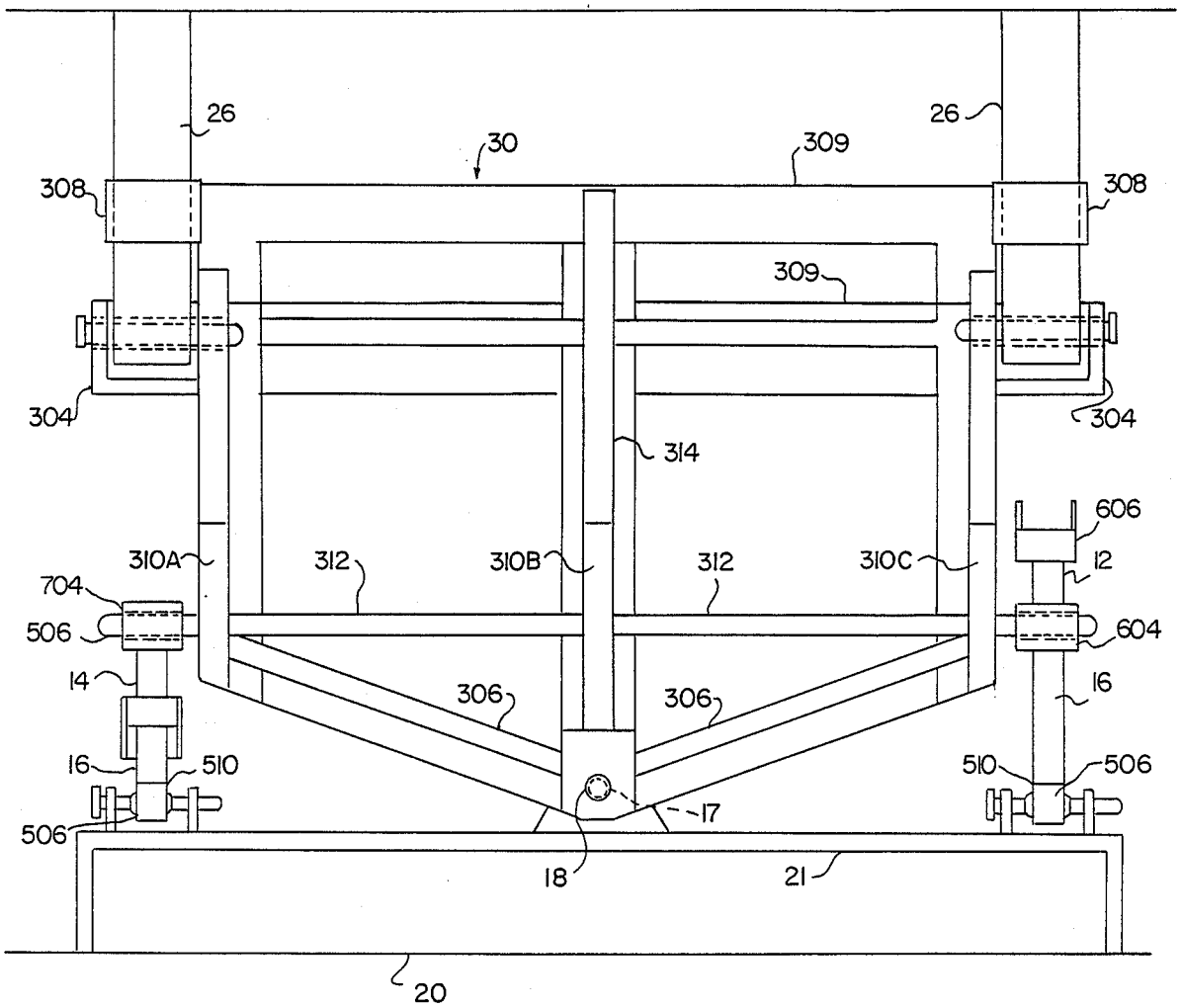
FIG. 2 is a top view of the converting assembly, attached to the lift frame members of a tractor and to an implement.

Frame 30 couples implement 20 to lift frame members 26 of tractor 10. Referring to FIGS. 2, 3 and 4, frame 30 suitably comprises front member 306, motion connector supports 310A, 310B and 310C, and a frame connector, generally indicated a 302. Front member 306 is suitably generally V-shaped in a generally horizontal plane, disposed across the front of frame 30, with a forward pointing apex. A pin hole 17 for receiving a pin 18 is provided in the apex of front member 306 to facilitate coupling to implement 20. The V-shape of front member 306 provides clearance needed to facilitate pivotal movement of implement 20 about pin 18. Supports 310 connect front member 306 to rigid frame connector 302 and are generally triangular in shape, extending upwardly from the plane of member 306. Frame connector 302 suitably comprises respective collars 308, lateral support members 309, stiffener 314, and respective pin connection boxes 304. Pin connection boxes 304 are suitably fixed externally of supports 310A and 310C at the rear of frame 30. Collars 308, suitably open box structures conforming in interior shape to lift frame members 26, are disposed at a predetermined angle with respect to pin connection box 304 and rigidly affixed thereto by lateral support members 309. Pivot bar 312 is journalled through bores in the apex of, and rigidly affixed to, motion connector supports 310. The ends of bar 312 extend through the bores of motion connector supports 310A and 310C to facilitate pivotal connection of motion connectors 12 and 14 to frame 30, as will be explained.

Figure 5A:
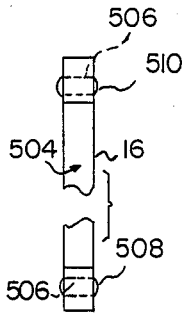
FIGS. 5A and B are top and side views, respectively, of turn connectors which communicate with the tilt cylinders and impart a predetermined motion to the implement.
Figure 5B:
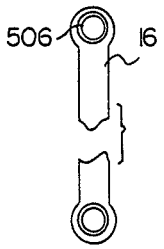
Figure 6A:
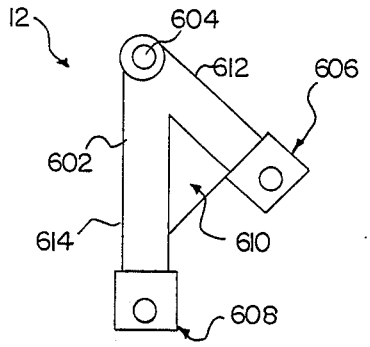
FIGS. 6A, B, and C are side, front, and back views, respectively, of an exemplary embodiment of the first of two motion connectors which pivot about the frame.
Figure 6B:
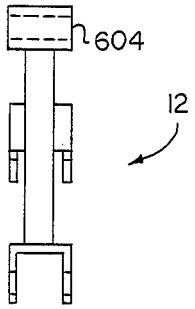
Figure 6C:
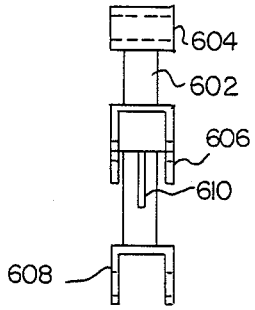
Figure 7A:
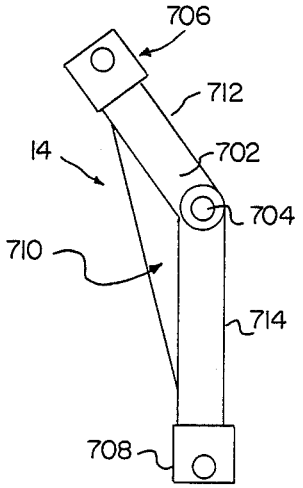
FIGS. 7A, B and C are side, front, and back views, respectively, of an exemplary embodiment of the second of two motion connectors.
Figure 7B:
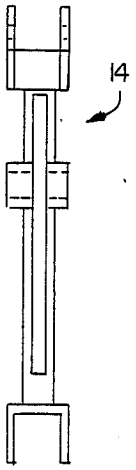
Figure 7C:
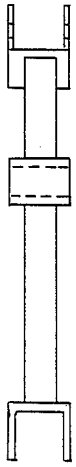

Motion connectors 12 and 14 cooperate with turn connectors 16 and frame 30 to couple tilt cylinders 22 and 24 to implement 20. As best seen in FIGS. 5A and 5B, turn connectors 16 suitably comprise a generally cylindrical shank portion 504 having turn connector joints 506 disposed at respective first and second ends 508 and 510. Motion connector 12, as best seen in FIGS. 6A–C, suitably comprises an angled brace portion 602, defining first and second legs 612 and 614, respectively, a pivot connection 604, forked ends 606 and 608, and a stiffener 610. With reference to FIGS. 7A–C, motion connector 14 suitably comprises an angled brace portion 702 defining first and second legs 712 and 714, respectively, a pivot connection 704, forked ends 706 and 708, and a stiffener 710.

Turn connectors 16 and motion connectors 12 and 14 couple implement 20 to tilt cylinders 22 and 24 to effect the desired side-to-side motion of implement 20. Referring again to FIGS. 2 and 8, pivot bar 312 extends through motion connector supports 310A–C and protrudes beyond supports 310A and 310C to facilitate pivotal connection of motion connectors 12 and 14 thereto at respective motion connector pivot connections 604 and 704 of motion connectors 12 and 14. Forked ends 606 and 706 of motion connectors 12 and 14 are pivotally connected to tilt cylinders 22 and 24, respectively. For clarity, tilt cylinders 22 and 24 are omitted from FIG. 2 and turn connectors 16 are broken away in FIG. 8. Forked ends 608 and 708 of motion connectors 12 and 14, respectively, are connected to respective first ends 508 of turn connectors 16 by turn connector joints 506. (Forked end 708 is hidden in FIG. 8.) Respective second ends 510 of turn connectors 16 are connected to bracket 21 by turn connector joints 506. Joints 506 are ball joints, universal joints, or any similar joint which allows at least limited freedom of motion in a plurality of directions. Bracket 21 is pivotally attached to frame 30 by pin 18 to permit pivotal motion of implement 20 in the horizontal plane and, preferably, substantially limit motion in the vertical plane.

Tractor lift frame members 26 are received in collars 308 of frame 30. A portion of member 26 extends beyond collar 308 and is secured to pin connection box 304 to rigidly attach frame 30 to lift frame members 26.

Tilt cylinders 22 and 24 are typically actuated simultaneously by a single control; they extend and retract in unison and are thus always equal in length. Assembly 100 converts extension and retraction of cylinders 22 and 24 into a side-to-side sweeping motion of implement 20. Moreover, it is desirable to provide an equal amount of travel in the clockwise and counterclockwise directions as implement 20 pivots about pin 18. This is accomplished by properly selecting the lengths and angles comprising motion connectors 12 and 14 such that implement 20 is disposed perpendicular to the longitudinal axis of tractor 10 when cylinders 22 and 24 are in the half-extended position as depicted in FIGS. 1, 2 and 8.

With specific reference to FIG. 8, when tilt cylinders 22 and 24 extend from the half-extended position, tilt cylinder 24 urges forked ends 606 and 608 of motion connector 12 in the clockwise direction. Turn connector 16, which is connected to forked end 608 of motion connector 12 at turn connector joint 506, is thereby urged to the left. As best seen in FIG. 2, turn connector 16 (lower right side of FIG. 2) is urged downward, which urges implement 20 in a clockwise direction about pin hole 18. At the same time, as seen in FIG. 8, extension of tilt cylinder 22 urges forked end 706 of motion connector 14 in a counter-clockwise direction. Forked end 708, which is hidden in FIGS. 2 and 8, is urged in a direction opposite to that of forked end 608 of motion connector 12, and hencê turn connector 16, shown at the bottom left of FIG. 2, is urged upward. Thus, when tilt cylinders 22 and 24 extend, motion connectors 12 and 14 force turn connectors 16 in opposite directions in a substantially horizontal plane, effecting clockwise pivotal motion of implement 20 about pin 18 (FIG. 2). Similarly, when tilt cylinders 22 and 24 retract, the action is reversed and implement 20 is urged in the counter-clockwise direction. In this way, extension or retraction of tilt cylinders 2 and 24 is converted into side-to-side motion of implement 20.

It will be understood that the above description is a preferred exemplary embodiment of the present invention, and that the invention is not limited to the specific forms described. Various substitutions, modifications, changes, and omissions may be made in the design and arrangement of the elements without departing from the scope of the appended claims.

I claim:

1. A converting assembly for attaching an implement to a tractor, said tractor being of the type having at least one lift frame member and at least one tilt cylinder, capable of extension and retraction, for imparting a scooping motion about a substantially horizontal axis to a bucket when the bucket is attached directly to the tractor, the assembly comprising:

a frame;

frame connecting means for rigidly but readily removably connecting said frame to said lift frame member;

means for pivotally connecting said implement to said frame for movement of said implement in a substantially horizontal plane; and means, pivotally mounted to said frame and interconnecting said tilt cylinder and said implement, for converting extension and retraction of said tilt cylinder into side-to-side motion of said implement in said substantially horizontal plane.

2. The assembly of claim 1 wherein said means for pivotally connecting said frame to said implement comprises a pin connection adapted to facilitate pivotal motion of said implement, such that said pivotal motion is substantially limited to a generally horizontal plane.

3. The assembly of claim 1 wherein said means for converting comprises at least one motion connector, responsive to extension and retraction of said tilt cylinder, for effecting side-to-side motion of said implement.

4. The assembly of claim 3 wherein said motion connector comprises a first leg pivotally connected to said tilt cylinder and a second leg cooperating with said implement.

5. The assembly of claim 4, further comprising ball joint means, cooperating with said second leg of said motion connector, for transmitting motion to said implement.

6. The assembly of claim 5 wherein said means for converting includes means for urging said ball joint means in a direction away from said tractor in response to said extension of said tilt cylinder.

7. The assembly of claim 5 wherein said means for converting includes means for urging said ball joint means in a direction toward said tractor in response to said extension of said tilt cylinder.

8. The assembly of claim 5 wherein said means for converting includes means for urging said ball joint means in a direction away from said tractor in response to said retraction of said cylinder.

9. The assembly of claim 5 wherein said means for converting includes means for urging said ball joint means in a direction toward said tractor in response to said retraction of said cylinder.

10. The assembly of claim 5 wherein:

said implement includes an integral bracket for interconnecting said implement to said assembly; and said means for converting further comprises a turn connector interconnecting said bracket at said ball joint and said second leg of said motion connector.

11. The assembly of claim 10, further comprising a pivot bar, rigidly mounted to said frame, wherein in response to said extension and retraction of said tilt cylinder, said motion connector pivots about said pivot bar, thereby effecting side-to-side motion of said implement.

12. The assembly of claim 10 wherein said turn connector is adapted to remain substantially parallel to the ground during said side-to-side motion of said implement.

13. The assembly of claim 1, wherein said frame connecting means comprises:

a pin connection member for retaining the distal end of said lift member therein; and a collar, rigidly secured to said pin connection member, for journalled engagement with said lift frame member;

wherein said frame connecting means maintains a substantially constant angle between said frame and said lift frame member.

14. The assembly of claim 1, wherein said at least one tilt cylinder comprises first and second tilt cylinders disposed to extend simultaneously and retract simultaneously.

15. The assembly of claim 10 wherein said means for pivotally connecting said frame to said implement comprises a pin connection adapted to facilitate pivotal motion of said implement in a substantially horizontal plane.

16. A converting assembly for attaching an implement to a tractor, said tractor being of the type having at least one lift frame member and first and second tilt cylinders adapted for simultaneous extension and simultaneous retraction, for imparting a scooping motion about a substantially horizontal axis to a bucket when the bucket is attached directly to the tractor, the assembly comprising:

a frame;

frame connector means for rigidly but readily removably connecting said frame to said lift frame member;

means for pivotally connecting said implement to said frame for movement of said implement in a substantially horizontal plane; and means for converting extension and retraction of said first and second tilt cylinders into side-to-side motion of said implement in said substantially horizontal plane.

17. The assembly of claim 16, wherein said means for converting comprising:

a first motion connector, responsive to extension and retraction of said first cylinder, and a second motion connector, responsive to extension and retraction of said second cylinder.

18. The assembly of claim 17, wherein said first and second motion connectors are pivotally mounted to said frame.

19. The assembly of claim 18, wherein said frame comprises:

a pivot bar rigidly secured thereto, said first and said second motion connectors being mounted on said pivot bar; and said implement comprises a bracket, having first and second ball joint means for interconnecting said implement and said assembly.

20. The assembly of claim 19 wherein said first motion connector has a proximal leg pivotally connected to said first cylinder and a distal leg cooperating with said first ball joint means, and said second motion connector has a proximal leg pivotally connected to said second cylinder and a distal leg cooperating with said second ball joint means.

21. The assembly of claim 20, wherein said converting means further comprises a first turn connector adapted for pivotal connection with said first ball joint means and said distal leg of said first motion connector, and a second turn connector adapted for pivotal connection with said second ball joint means and said distal leg of said second motion connector.

22. The assembly of claim 20, further comprising means, responsive to extension of said first and second cylinders, for urging said first ball joint means toward said tractor and said second ball joint means away from said tractor to effect side-to-side motion of said implement.

23. The assembly of claim 21, wherein said first and second turn connectors are disposed in a substantially horizontal plane during said side-to-side motion of said implement.

* * * * *